US010302260B2

(12) United States Patent
Crompton

(10) Patent No.: US 10,302,260 B2
(45) Date of Patent: May 28, 2019

(54) ILLUMINATING SAFETY NET

(71) Applicant: NICAUD COMPANIES 22 (PTY) LTD., Rustenburg (ZA)

(72) Inventor: Brendan Robert Crompton, Rustenburg (ZA)

(73) Assignee: NICAUD COMPANIES 22 (PTY) LTD., Rustenburg (ZA)

( * ) Notice: Subject to any disclaimer, the term of this patent is extended or adjusted under 35 U.S.C. 154(b) by 0 days.

(21) Appl. No.: 15/730,873

(22) Filed: Oct. 12, 2017

(65) Prior Publication Data

US 2018/0106438 A1 Apr. 19, 2018

(30) Foreign Application Priority Data

Oct. 13, 2016 (ZA) ..... 2016/07044

(51) Int. Cl.

| | |
|---|---|
| ***F21S 4/15*** | (2016.01) |
| ***E01F 7/04*** | (2006.01) |
| ***E02D 17/20*** | (2006.01) |
| ***F21V 33/00*** | (2006.01) |
| ***F21S 4/26*** | (2016.01) |
| *F21W 131/402* | (2006.01) |
| *F21Y 103/10* | (2016.01) |
| *F21Y 115/10* | (2016.01) |
| *F21Y 103/20* | (2016.01) |

(52) U.S. Cl.

CPC ..... *F21S 4/15* (2016.01); *E01F 7/045* (2013.01); *E02D 17/20* (2013.01); *F21S 4/26* (2016.01); *F21V 33/00* (2013.01); *F21W 2131/402* (2013.01); *F21Y 2103/10* (2016.08); *F21Y 2103/20* (2016.08); *F21Y 2115/10* (2016.08)

(58) Field of Classification Search

CPC . F21S 4/15; F21S 4/26; F21Y 2103/10; F21Y 2103/20; F21Y 2115/10; F21V 33/00; E01F 7/045; E02D 17/20; F21W 2131/402

See application file for complete search history.

(56) References Cited

U.S. PATENT DOCUMENTS

| | | | | |
|---|---|---|---|---|
| 5,787,955 | A * | 8/1998 | Dargie | E02D 29/12 160/368.1 |
| 6,969,185 | B1 * | 11/2005 | Adair | B60Q 7/00 160/10 |
| 2010/0134025 | A1 * | 6/2010 | Link | H05B 33/0842 315/185 R |
| 2010/0286910 | A1 * | 11/2010 | Hudson | F21S 4/10 701/469 |
| 2012/0182755 | A1 * | 7/2012 | Wildner | G09F 9/301 362/555 |
| 2015/0342307 | A1 * | 12/2015 | Weber | A44C 5/00 368/282 |

* cited by examiner

*Primary Examiner* — Kevin Quarterman
(74) *Attorney, Agent, or Firm* — Young & Thompson

(57) ABSTRACT

Disclosed is an illuminating safety net which includes a net body which has a quadrilateral perimeter of elongate tensile members, and a plurality of elongate tensile elements attached to the perimeter and extending within the perimeter in at least two transverse directions; and an elongate flexible lighting strip engaged to the net body along at least part of a perimeter edge of the perimeter.

5 Claims, 1 Drawing Sheet

ILLUMINATING SAFETY NET

BACKGROUND OF THE INVENTION

The invention relates to an illuminating safety net.

Lighting is an issue in underground mine excavations. To provide adequate lighting, particularly in the working areas or stopes of the mine, requires a complex electrical installation of bulbs, power lines, means to attach and suspend the bulbs and power lines and intermittent accessible electricity supply points.

In a typical lighting system, a string of bulbs is suspended from a wall of the excavation, interlinked by a power cable. The bulbs are interspersed on this cable at intervals that create an uneven lighting pattern.

The current invention at least partially solves the aforementioned problem.

SUMMARY OF INVENTION

The invention provides an illuminating safety net which includes a net body which has a quadrilateral perimeter of elongate tensile members, and a plurality of elongate tensile elements attached to the perimeter and extending within the perimeter in at least two transverse directions; and an elongate flexible lighting strip engaged to the net body along at least part of a perimeter edge of the perimeter.

The flexible lighting strip may include at least one length of flexible plastic tubing, and a string of electrically interlinked LEDs in the tubing and a connector terminal or power supply connector at one end of the string of LEDs.

Preferably, the lighting strip extends about the entire perimeter edge of the net.

The safety net may include an attachment means for attaching the lighting strip to the net body.

The attachment means may be a plurality of attachment loops, each of which presents laterally of the perimeter. The lighting strip may be threaded through each of the loops in engagement of the lighting strip to the net body.

Alternatively, the lighting strip may be tied or fastened to the safety net by any suitable means, for example, by using a plurality of cable ties or the like.

BRIEF DESCRIPTION OF THE DRAWINGS

The invention is described with reference to the following drawings in which.

DESCRIPTION OF PREFERRED EMBODIMENTS

Figure 1:
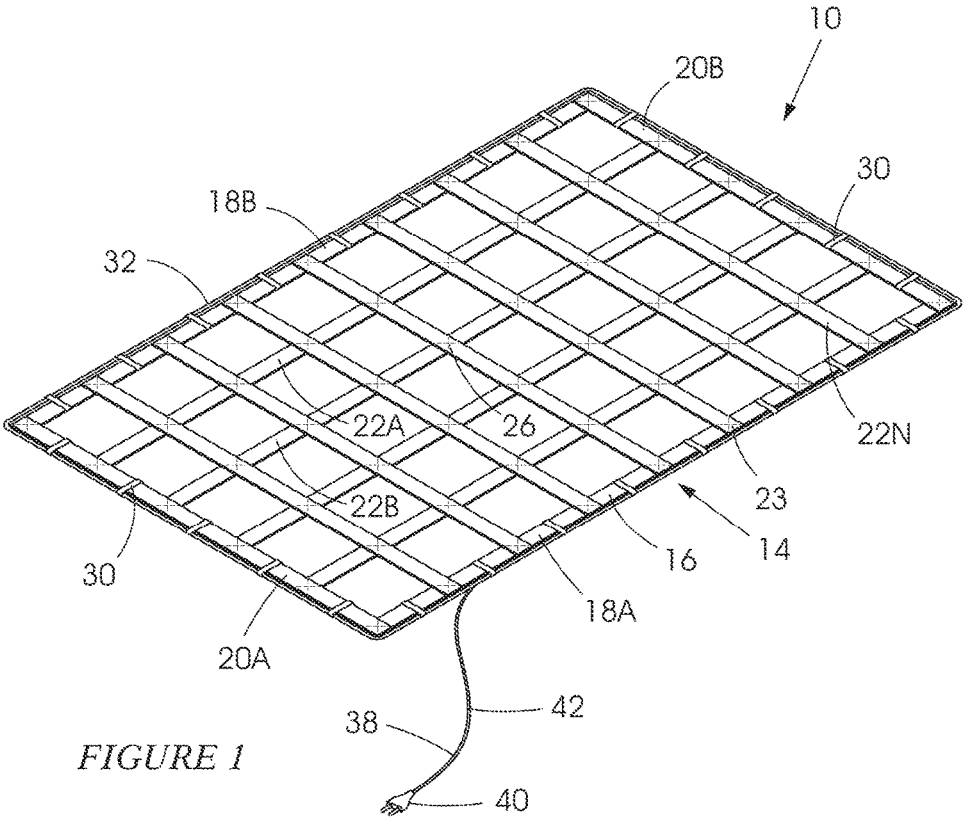
FIG. 1 illustrates, in plan, an illuminating safety net in accordance with the invention.
Figure 2:
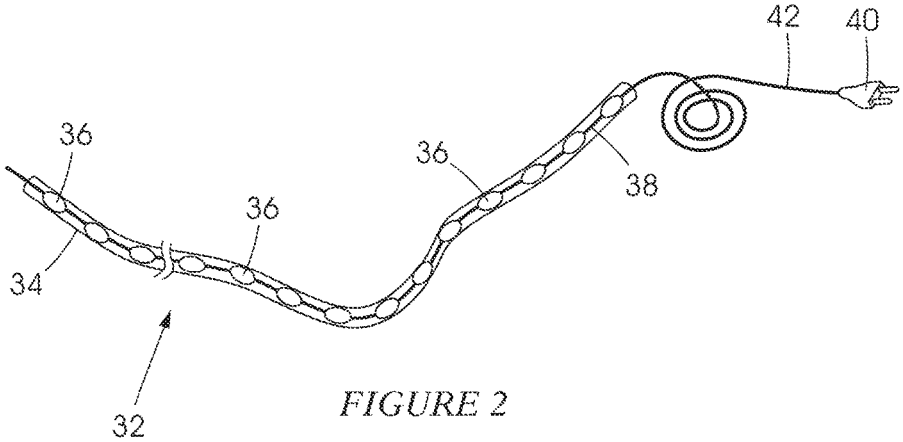
FIG. 2 illustrates a length of lighting tube which is attached to the perimeter of a body of the safety net.

FIG. 1 illustrates an illuminating safety net 10, in accordance with the invention, which is installed, with the aid of hooks (not shown) to preinstalled support (not shown), which is engaged to a hanging wall (not shown) of a mine excavation, to prevent rock fall from the hanging wall harming a mine worker beneath.

This particular net however, serves an additional function: that of illuminating the area beneath the safety net which, in the mine excavation, is an active work area.

This safety net 10 has a quadrilateral mesh body 14 defined by a perimeter 16 which is comprised of a pair of longitudinal members, respectively designated 18A and 18B and a pair of transverse members, respectively designated 20A and 20B.

Within the perimeter, the body 14 includes a grid of elongate tensile elements which extend in a first direction, parallel to the transverse members 20, and a second direction, parallel to the longitudinal members 18. These elements are designated, in no particular order, 22A, 22B . . . 22N. Each element intersects and engages with a member (18, 20) at an attachment location 23.

The elements 22 cross one another at overlap points 26. At the overlap points, the intersecting elements are stitched together or otherwise secured together by any other suitable means.

The elements (22, 24) and the members (18, 20) are straps of a suitable tensile fabric material.

In this particular example, the safety net 10 includes a plurality of attachment loops 30 extending transversely from the perimeter 16 and spaced at regular intervals along each member (18, 20).

The safety net 10 includes a lighting tube 32 which, in this example, runs along the entire perimeter 16 and which is attached thereto by being threaded through each loop 30.

In this example, the lighting tube 32 consists of a single length of flexible plastic tubing 34 and a plurality of LEDs 36 that are electrically interlinked by a power supply line 38. The LEDs can be connected in series or parallel. The power supply line terminates at one end, in a power source connector or plug 40. However it is anticipated, within the scope of this invention, that the lighting tube comprises a plurality of lengths, each length electrically connectable to a preceding or following length.

The plastic tubing 34 will be of a suitable plastic material that is protective to the LEDs contained therein, excluding the ingress of dirt and debris, whilst being flexible and sufficiently translucent or transparent so as not to absorb any of the light emanating from the LEDs.

The benefit of the illuminating safety net 10 is that it is a flexible structure, capable of being folded or rolled prior to installation, with the lighting tube hindering the folded or rolled configuration. When the net is required, it is unfolded or unrolled, elevated to the hanging wall and attached to preinstalled support as mentioned above. Then, to provide the secondary function of light, the plug 40, at a trailing end section 42 of the power line 38, is merely plugged into the nearest available power source portal.

Furthermore, below the installed net, the work area is more evenly and brightly lit.

The invention claimed is:

1. An illuminating safety net comprising:

a net body which has a quadrilateral perimeter of elongate tensile members of a tensile fabric material, and a plurality of elongate tensile elements of a tensile fabric material, attached to the perimeter and extending within the perimeter in at least two transverse directions; and an elongate flexible lighting strip including at least one length of flexible plastic tubing, a string of electrically interlinked light emitting diodes (LEDs) in the tubing, and a connector terminal or power supply connector at one end of the string of LEDs, the elongate flexible lighting strip being engaged to the net body about the entire perimeter edge of the perimeter, wherein the safety net is configured to engage a hanging wall of a mine excavation.

2. The illuminating safety net according to claim 1, wherein the safety net includes a peripheral attachment system configured to attach the lighting strip to the net body.

3. The illuminating safety net according to claim 2, wherein the attachment system is a plurality of attachment loops, each of the attachment loops presenting laterally of the perimeter.

4. The illuminating safety net according to claim 1, wherein the lighting strip is tied or fastened to the safety net.

5. The illuminating safety net according to claim 1, wherein the net is configured to receive rocks fallen from the hanging wall.

* * * * *